US006931909B2

(12) United States Patent
Tokunaga

(10) Patent No.: US 6,931,909 B2
(45) Date of Patent: Aug. 23, 2005

(54) PUNCH PRESS

(75) Inventor: Hironori Tokunaga, Isehara (JP)

(73) Assignees: AMADA Co., Ltd, Kanagawa (JP); Matsushita Electric Industrial Co., Ltd., Osaka (JP)

( * ) Notice: Subject to any disclaimer, the term of this patent is extended or adjusted under 35 U.S.C. 154(b) by 91 days.

(21) Appl. No.: 10/451,636

(22) PCT Filed: Jan. 10, 2002

(86) PCT No.: PCT/JP02/00088

§ 371 (c)(1),
(2), (4) Date: Jul. 10, 2003

(87) PCT Pub. No.: WO02/055229

PCT Pub. Date: Jul. 18, 2002

(65) Prior Publication Data

US 2004/0055358 A1 Mar. 25, 2004

(30) Foreign Application Priority Data

Jan. 11, 2001 (JP) ..... P2001-004108

(51) Int. Cl.[7] ..... B21J 13/00

(52) U.S. Cl. ..... 72/446; 72/448; 72/455; 483/28; 100/257

(58) Field of Search ..... 72/441, 446, 448, 72/449, 455, 456; 483/28, 29; 100/226, 257; 83/549, 551, 553, 561, 562, 563

(56) References Cited

U.S. PATENT DOCUMENTS 4,090,391 A * 5/1978 Hish ..... 72/422
5,205,149 A * 4/1993 Hayashi ..... 72/446
5,269,739 A 12/1993 Maynard et al.
5,342,276 A * 8/1994 Fujiwara et al. ..... 483/29
5,367,935 A 11/1994 Matsuda
5,419,225 A 5/1995 Fujita
5,451,195 A 9/1995 Fujiwara et al.
5,616,112 A * 4/1997 Seto et al. ..... 483/29
5,669,866 A * 9/1997 Julian et al. ..... 483/1
6,024,681 A * 2/2000 Latten et al. ..... 483/29

FOREIGN PATENT DOCUMENTS

| | | | |
|---|---|---|---|
| EP | 0530813 | * 3/1993 | ..... B21D/28/12 |
| JP | 64-27126 | 2/1989 | |
| JP | 80085/1989 | 3/1991 | |
| JP | 3-18013 | 4/1991 | |
| JP | 7-47140 | 11/1995 | |
| JP | 10118723 | 5/1998 | |
| WO | 90/05601 | 5/1990 | |

OTHER PUBLICATIONS

English Language Abstract of JP 10–118723.

* cited by examiner

*Primary Examiner*—Ed Tolan
(74) *Attorney, Agent, or Firm*—Greenblum & Bernstein, P.L.C.

(57) ABSTRACT

In a cube space having high rigidity, the following members are provided: a die holder (103) which can be pulled out forward, a punch holder (47) fixed to a separate bridge structure, a striker which can be positioned in an XY plane for selecting a desired punch P, a striker supporting frame (59) which can be positioned in the XY plane for selecting a desired punch P and which can slide in a horizontal direction, and a clamp device (232) having clamp arms (233) which are provided with a vertically movable ram (37) and which can enter between the punch holder (47) and the die holder (103) and which hold the opposed ends of the workpiece W. Therefore, it is possible to constitute a punch press (1) which is suitable for precise machining of a thin plate and in which tools can easily be exchanged.

14 Claims, 12 Drawing Sheets

PUNCH PRESS

This application is a 35 USC 371 of PCT/JP02/00088 filed Jan. 10, 2002.

TECHNICAL FIELD

The present invention relates to a punch press in which a striker strikes a punch held by a punch holder for carrying out punching work in cooperation with a die held by a die holder.

BACKGROUND ART

As conventional punch presses for selecting tools, two types punch presses are known, i.e., a type I in which a striker is fixed and a tool placed on a turret moves, and a type II in which the striker moves and the tool is fixed.

The prior art in type I is an example of a turret punch press in which a tool is placed on a rotation turret. Japanese Utility Model Publication No. H7-47140 discloses a method in which a single striker which straightforwardly moves selectively strikes two tools. That is, rotation positioning of a turret and straightforward movement of the striker are combined to finally select a tool.

It can be said that the prior art of type II is inferior in stability of tool position, and working precision such as a size of a machining device (height of productivity per installation area). In a striker mechanism as one example of the type II, a striker holder having a plurality of strikers which respectively strike heads of punches is provided above a plurality of tools (punches) set in the punch holder, and a ram is provided above the striker holder such that the ram can reciprocate in longitudinal direction and lateral direction (X-axis direction and Y-axis direction).

When the striker strikes the punch, the ram itself moves in the X-axis direction and the Y-axis direction to select a desired punch, the punch is positioned above the striker on the punch and then, the punch is lowered in the vertical direction (Z-axis direction), the striker strikes to carry out the punching working.

However, the prior art of the type I is based on index of the tools by rotation turret, and this technique has a problem in precision when a tool hole into which the tool is mounted is worked into a turret. This does not cause a problem in a general sheet metal working which is carried out by a conventional turret punch press, but if a product working having the same extremely high precision as that required for integrally forming thin plate by a press machine in electronic component industry is carried out by a punch press, it is required that distances between rotation centers of turrets and centers of tool holes are the same with high precision, but the working in a producing process of current turrets is extremely difficult operation, and even if it is possible, the cost is increased. That is, it is not preferable for high precision working to use a rotation member such as a turret for positioning. Further, there is a limit for positioning and stopping precision and positioning speed of the heavy rotation turret in which a tool is disposed. In Japanese Utility Model Publication No. H7-47140, in order to enhance the yield, two rotation positioning operations of a turret and a rotation cylinder which rotates in the turret are required, and it becomes more difficult to enhance the precision.

In the prior art of the type II, the ram strikes the punch, endures a high load, has a vertically driving mechanism, and if the mechanism is moved in the X-axis direction and Y-axis direction, there are problems that a guiding device and driving mechanism required for moving the ram becomes complicated, and volumes and costs thereof are increased, and energy consumption is also increased.

The present invention has been achieved with a view of the problems of the prior art, and it is an object of the invention to provide a punch press for a thin plate capable of precise working.

DISCLOSURE OF THE INVENTION

To achieve the above object, a punch press according to a first aspect of the present invention comprises: a base frame; a die holder mounted on the base frame; a rectangular punch holder fixed on an upper position of the die holder and provided thereon with a large number of punches arranged in many rows and many lines; a striker supporting frame provided on an upper position of the punch holder and having a striker which can be positioned in an XY plane, the striker being supported by the striker supporting frame such that the striker can strike the punch; and a vertically movable ram provided on an upper position of the striker supporting frame, the ram having a striking surface for covering an XY plane region where the striker moves, wherein the die holder can be pulled out in a horizontal direction.

With this structure, when a punching working is carried out, only a light weighted striker is moved above a desired tool from a tool group placed on a fixed holder, the tool is selected, and the ram which simply vertically moves strikes the punch through the striker to carry out the punching working.

Therefore, energy of the ram mechanism is reduced, a structure of the rotation turret is omitted, the punch holder and the die holder during working are fixed, centering precision is enhanced, and the selecting speed of die can be enhanced.

When dies are exchanged or maintenance is performed, the die holder can be pulled out in the horizontal direction, especially toward an operator, the operation can be carried out efficiently. As a result, there is no obstruction above the die holder and thus, the dies can be exchanged easily.

When the working is carried out, it is only necessary to position the die holder on which one die of the tool is mounted and thus, the positioning can be carried out with precision.

Since the left and right ends of the punch holder are strongly fixed to the base frame, the rigidity of the punch holder support section is enhanced. Therefore, the punch holder support section does not receive the distortion and thus, the working precision is enhanced.

A punch press according to a second aspect of the present invention comprises: a base frame; a die holder mounted on the base frame in which dies are arranged in many rows and many lines on an XY plane; a punch holder provided on an upper position of the die holder in which left and right ends of the punch holder are strongly fixed to the base frame to form a bridge structure, and punches paring up with the dies are arranged in many rows and many lines on an XY plane; a striker supporting frame provided on an upper position of the punch holder, the striker supporting frame having a striker capable of striking the punch and moving in the XY plane; and a ram provided on an upper position of the striker supporting frame, the ram vertically moving such that the ram can strike the striker irrespective of position of the striker; wherein the die holder can be pulled out in a horizontal direction.

Therefore, features of the punch press according to the first aspect can be obtained. Further, since the left and right ends of the punch holder are strongly fixed to the base frame, the rigidity of the punch holder support section is enhanced. Further, the bridge is separated from the structure which supports the ram, the bridge does not receive the distortion and thus, the working precision is enhanced.

A third aspect of the present invention provides the punch press according to the first or second aspect, wherein the striker supporting frame is capable of moving in the horizontal direction.

When the punch of the fixed punch holder is exchanged or maintenance is performed for the punch, it is necessary to obtain a space in the upper surface of the holder. Therefore, the upper surface of the punch holder is covered, and the striker is moved to a rear retreat position in the horizontal direction together with the slide frame which movably supports the striker, thereby securing the space of the upper surface of the holder. Since the slide frame is retreated rearward which is opposite direction as viewed from the operator, it is possible to easily and simply exchange the punches and perform the maintenance of the punch holder.

According to this structure, the centering between the upper and lower punches and the die seriously affect the working precision, but even if the center of the striker and the center of the punch head are not so strict, this does not affect the straightforwardness at the time of lowering of the punch. Therefore, the striker which does not adversely affect can be retreat and the punch holder is fixed and thus, and it is possible to enhance the operability without deteriorating the precision.

A fourth aspect of the present invention provides the punch press according to any one of the first to third aspects, wherein a ceiling frame is supported by at least four columns which stand on the base frame, the ram is provided in the vicinity of a center of the ceiling frame surrounded by the columns; and the punch holder and the die holder are surrounded by the columns in correspondence with the structure.

A large force generated at the time of working is supported by the cubic structure having high rigidity. Therefore, it is possible to prevent, to a minimum, the die holder, the punch holder and the striker supporting frame disposed in central area of this space from being distorted and thus, it is possible to enhance the working precision.

Further, since the punch holder is supported by a bridge structure which is separate from the ceiling frame which supports the ram, the punch holder does not receive distortion which is generated in the entire structure and thus, the working precision can be enhanced for this reason also.

A fifth aspect of the present invention provides the punch press according to any one of the first to fourth aspects, wherein the punch press further comprises a clamp section for clamping opposed opposite sides of a plate-like workpiece, wherein in order to make it possible for the clamp section to enter a gap between the punch holder and the die holder, a vertical height of the clamp section is set smaller than the gap; a width of a plane of the clamp section is set greater than the vertical height thereof; and th punch press further comprises a clamp device which can be positioned in X-axis direction and Y-axis direction in a rear end.

As a first point, in order to enhance the precision in the thin plate working, it is preferable that a vertical clearance between the punch holder and the die holder is smaller so as to suppress the vertical stroke amount of the punch. As a second point, it is also necessary for the precise working to clamp the opposite sides of the plate-like workpiece to suppress the bending of the workpiece and to position by stable holding. The clamp arm must be able to insert into this clearance so as not to deteriorate the yield. The requirements of the first and second points need to solve the mutually contradictory facts that the clearance must be smaller and the height of the clamp arm must be increased so as to enhance the rigidity of the clamp arm. Thereupon, the height of the clamp arm is reduced, and in order to compensate the reduction of rigidity caused by the reduction of the height, its width is increased. With this shape, it is possible to stably hold the clamped workpiece W against a horizontal stress generated at the time of positioning, and the distance between the punch and the die can be reduced. Since the clamp device having such a structure is disposed in the rear side which is the opposite direction from the pulling-out direction of the die holder, the operation carried out in the front side is not hindered.

BEST MODE FOR CARRYING OUT THE INVENTION

The embodiment of the present invention will be explained in detail with reference to the drawings.

Figure 1:
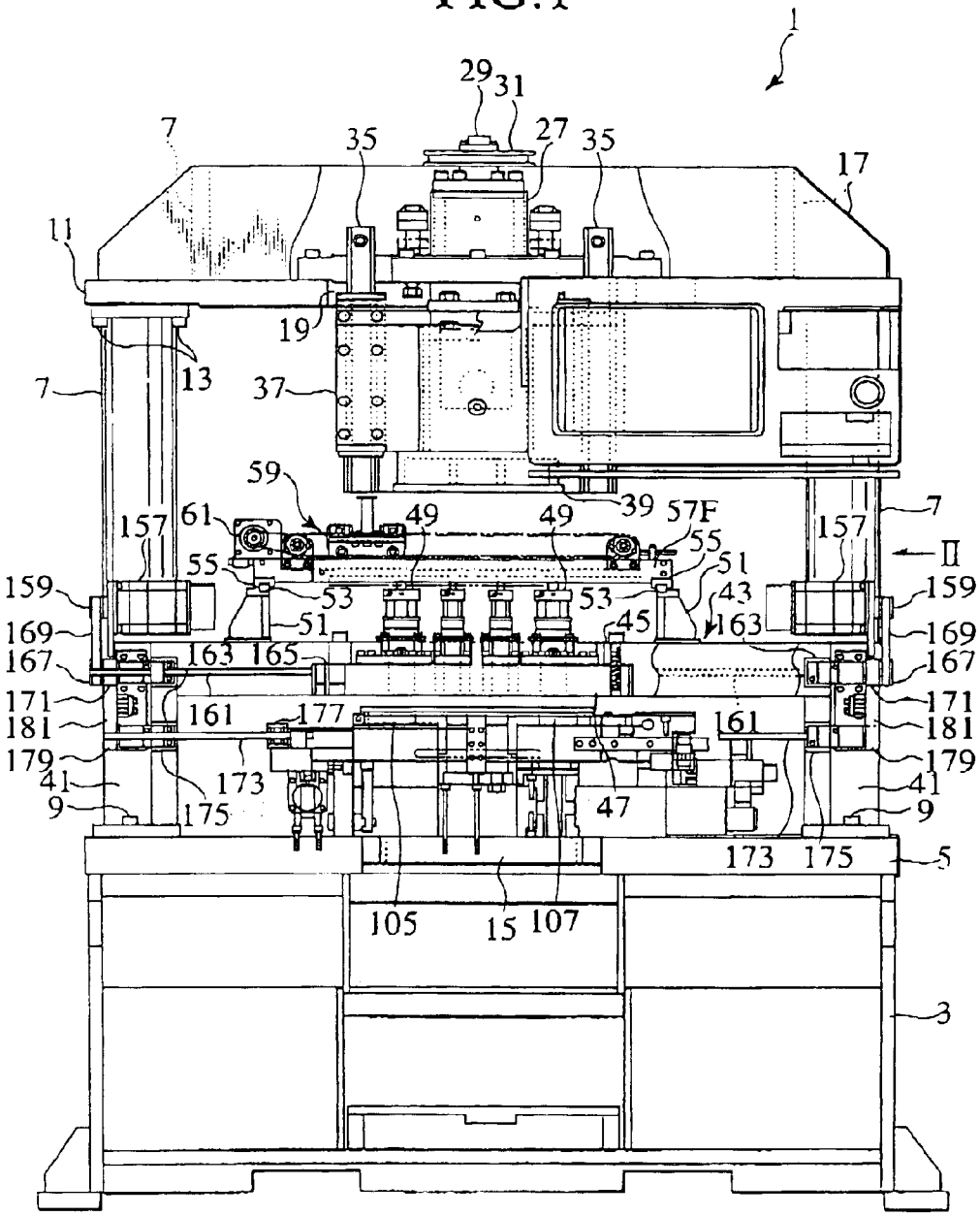
FIG. 1 is a front view of an entire punch press.
Figure 2:
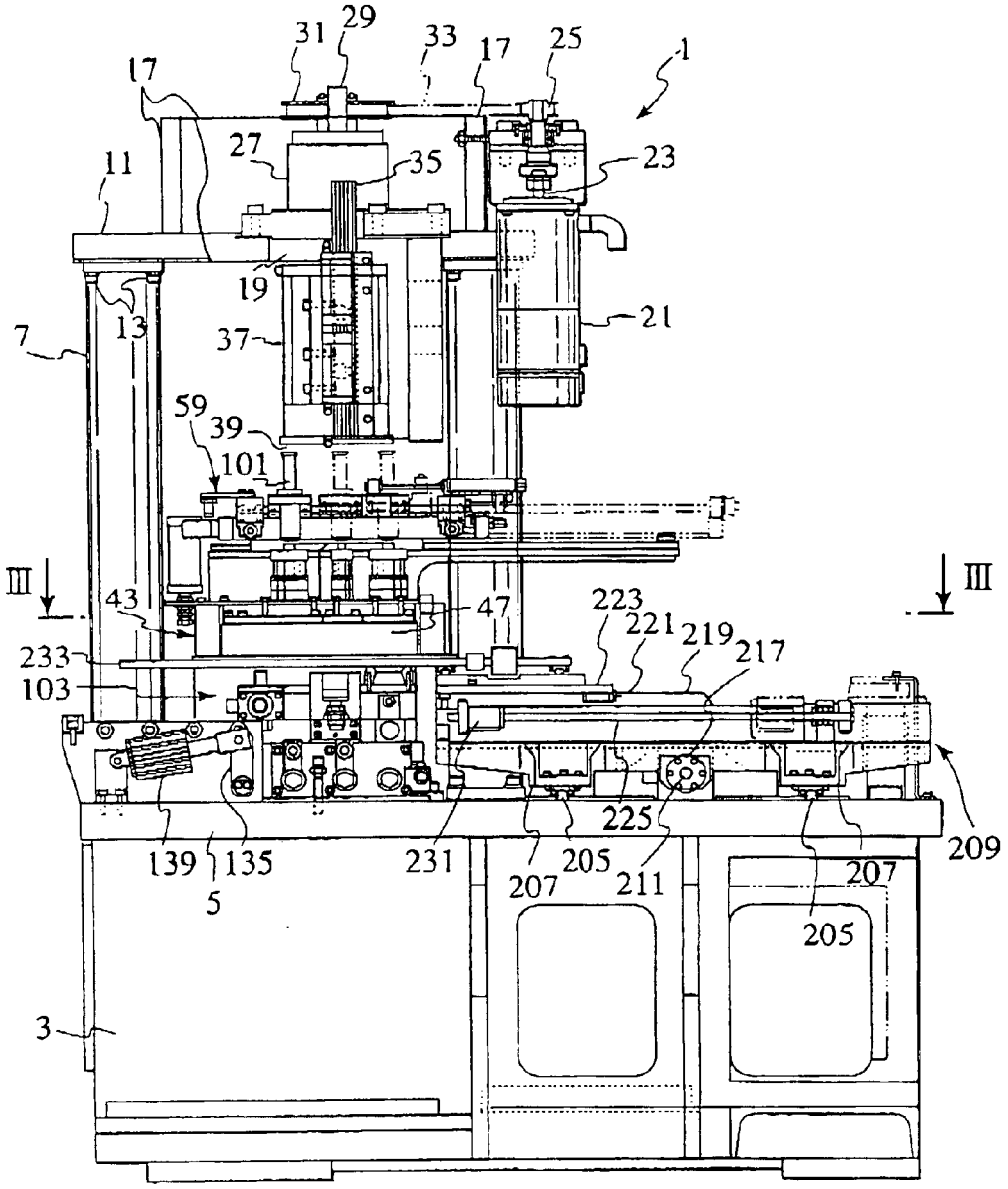
FIG. 2 is a side view taken along a direction II in FIG. 1.
Figure 3:
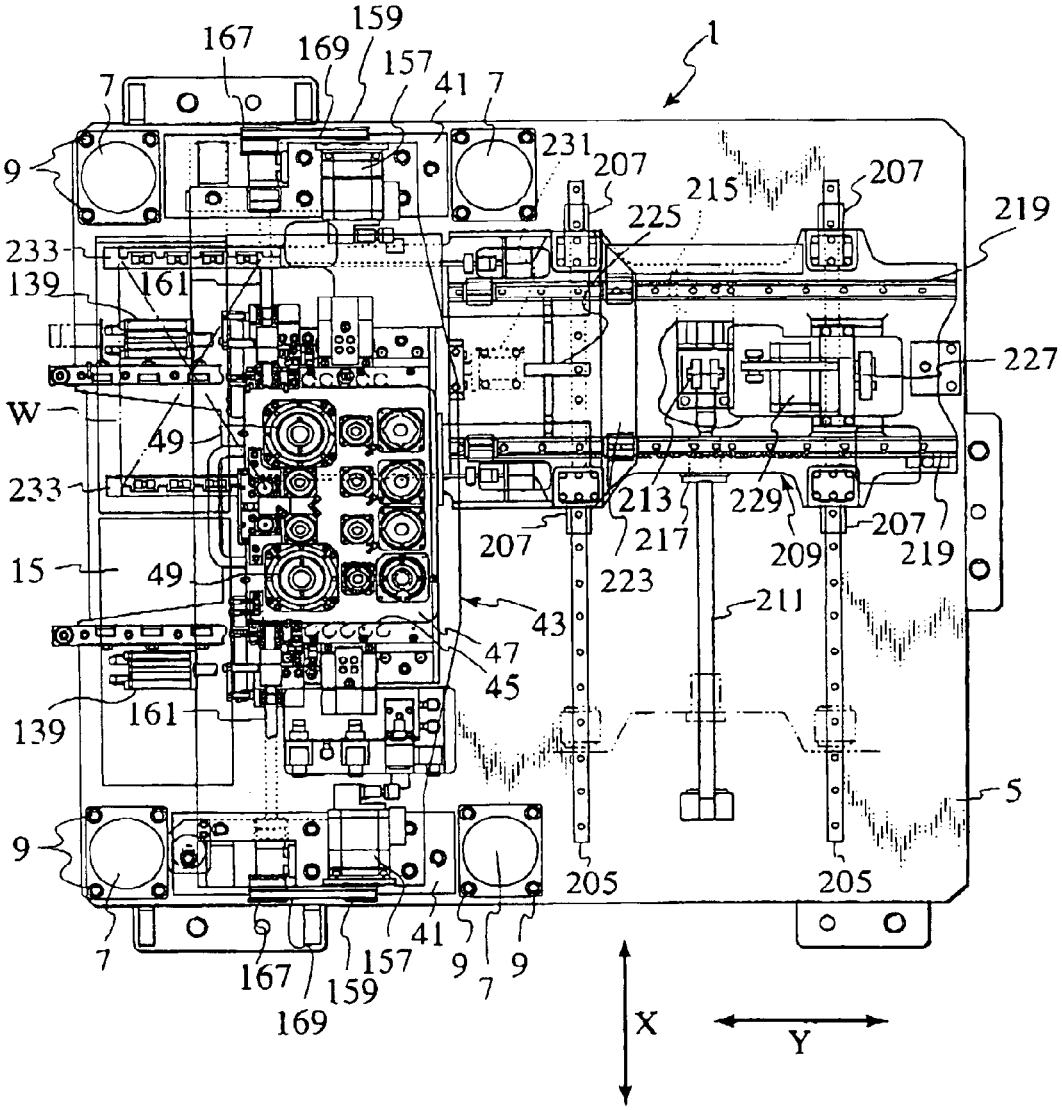
FIG. 3 is a sectional view taken along a line III—III in FIG. 2.

FIGS. 1 to 3 show an entire punch press 1 according to the invention. In this precise punch press 1, a structure which suppresses bending and vibration of the entire punch press 1 during presswork as small as possible is employed. That is, a pedestal 3 is provided at its upper surface with a thick base plate 5. Four rigid and thick columns 7 are fixed to front, rear, left and right ends of the base plate 5 through bolts 9. A ceiling frame 11 is fixed to upper sides of the columns 7 through bolts 13. A recess 15 (see FIG. 7) is formed in a front central portion of the base plate 5. A space is secured in a lower surface of an under-mentioned die holder to facilitate an operator's die-exchanging operation.

Reinforcing ribs 17 are provided on front, rear, left and right portions of an upper surface of the ceiling frame 11. The reinforced ceiling frame 11 is provided at its central portion with and opening 19. The reinforcing rib 17 on the rear side of the ceiling frame 11 (right side in FIG. 2) is provided with a striking driving motor 21 having a rotation shaft 23. The rotation shaft 23 is directed upward, and is provided with a drive pulley 25.

A drive-ball screw 29 vertically extends through the opening 19 of the ceiling frame 11. The drive-ball screw 29 is rotatably supported by a bearing 27 which is strong against vertical external force. A follower pulley 31 is mounted on an upper end of the drive-ball screw 29. A belt 33 is wound around the follower pulley 31 and the drive pulley 25.

The drive-ball screw 29 is provided at its both left and right sides (both left and right sides in FIG. 1) with a pair of ram-guide rails 35 which vertically extends in parallel to each other. A ram 37 capable of vertically moving is provided along the ram-guide rails 35. A ball (circulation type) nut (not shown) is mounted on the ram 37. The ball nut engages with the ram-ball screw 29 and vertically moves. The ram 37 is provided at its lower surface with a flat striking surface 39.

Therefore, if the striking driving motor 21 rotates the belt 33 to rotate the ram-ball screw 29, the ram 37 vertically moves along the ram-guide rails 35 through the ball nut which engages with the ram-ball screw 29.

Between the base plate 5 of the pedestal 3 and the ceiling frame 11, the base plate 5 is provided at its ends (left and right ends in FIG. 1) with support pedestals 41. An intermediate frame 43 is provided horizontally such that left and right ends thereof are supported by the support pedestals 41 like a bridge. The central opening 45 of the intermediate frame 43 is integrally provided with a punch holder 47. On the punch holder 47, a plurality of punches P (here, 3 punches×4 rows=12 punches) are disposed in its rectangular region. Index punches 49 are mounted on left and right outer sides of the front row (upper and lower outsides on the left side in FIG. 3) of the punch holder 47.

Figure 4:
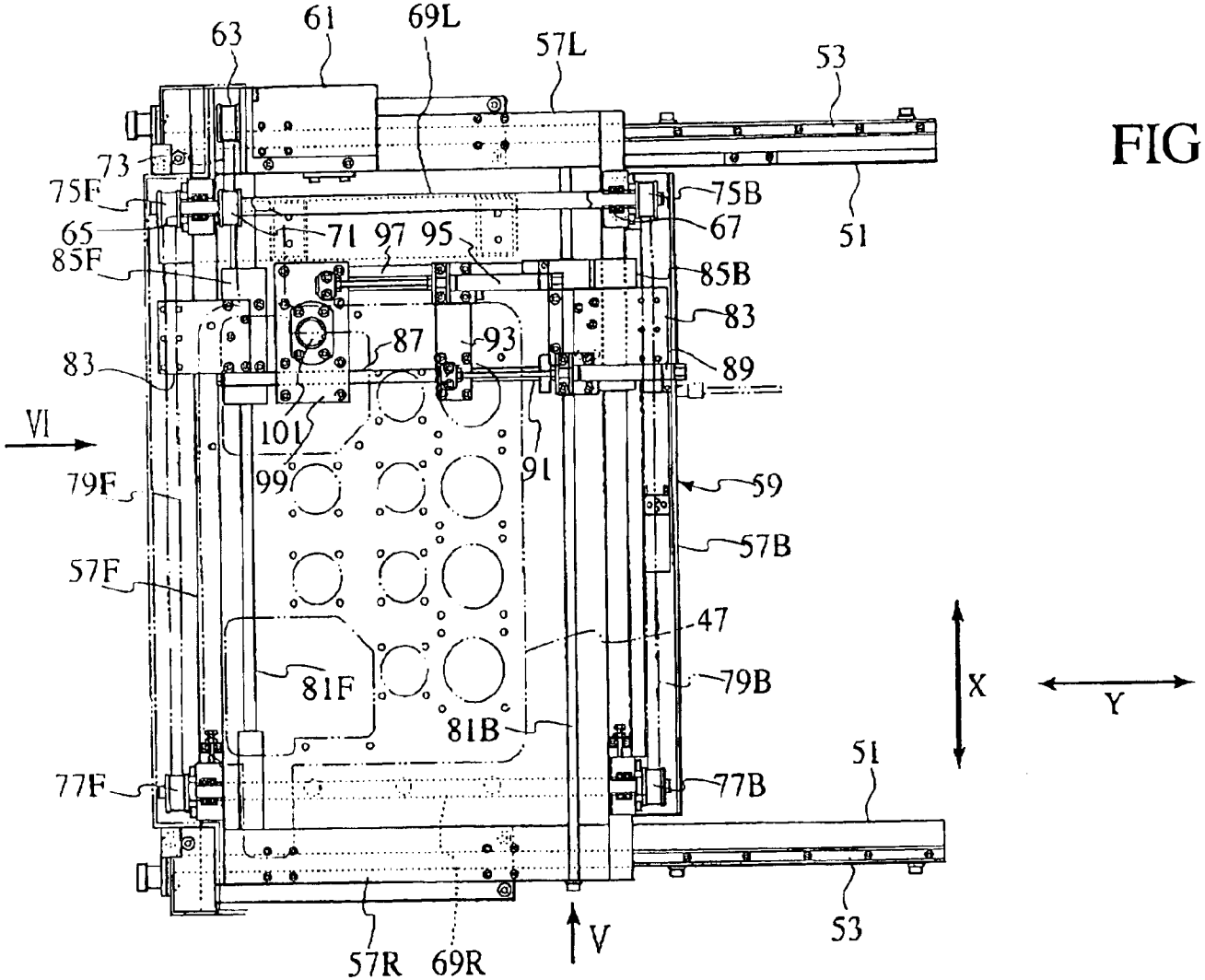
FIG. 4 is a plan view showing a striker supporting frame.
Figure 5:
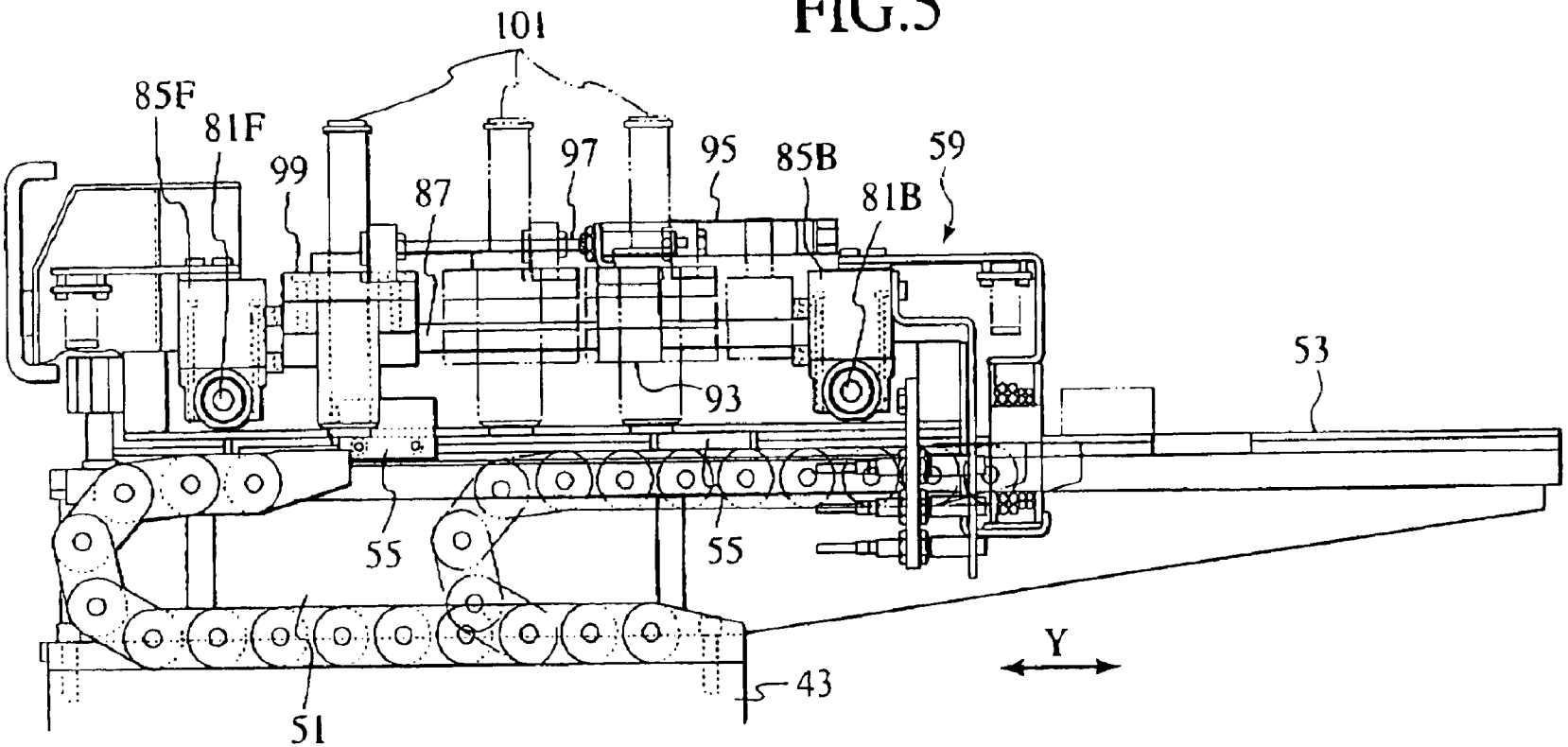
FIG. 5 is a side view taken from a direction V in FIG. 4.
Figure 6:
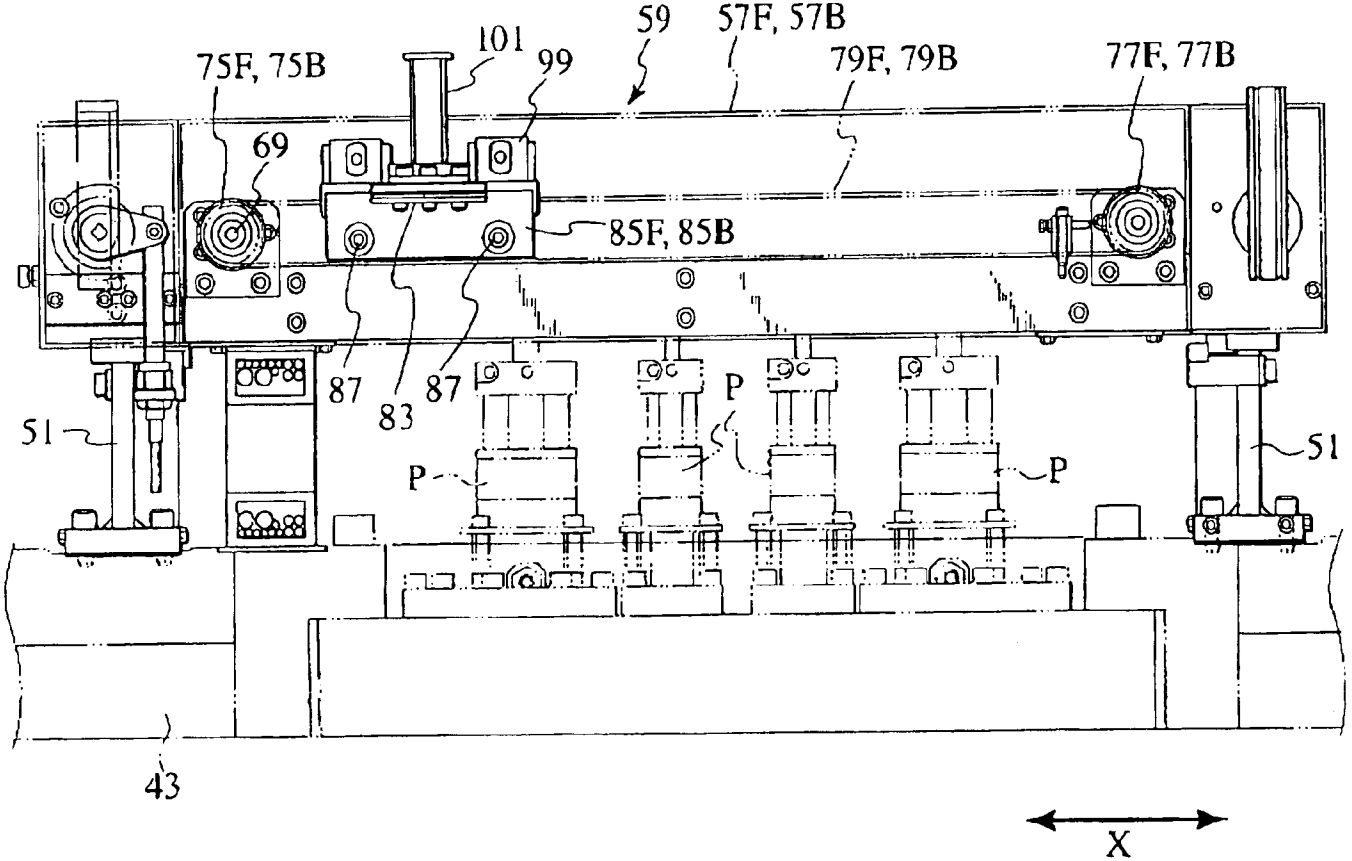
FIG. 6 is a front view taken along a direction VI in FIG. 4.

Referring to FIGS. 4 to 6 in addition to FIG. 1, stages 51 are provided on left and right ends of an upper surface of the intermediate frame 43. The stages 51 are long in a Y-axis direction which is a longitudinal direction (lateral direction in FIG. 4). Guide rails 53 are provided on an upper surface of each the stages 51 such that the guide rails 53 extends in the Y-axis direction which is the longitudinal direction.

A rectangular striker supporting frame 59 is provided on each of the guide rails 53. The striker supporting frame 59 comprises, as slide frames, a pair of left and right frames 57L and 57R provided at their bottom surface with a plurality of sliders 55 which are movable along the guide rails 53, a front frame 57F which connects front ends (left ends in FIG. 4) of the left and right frames 57L and 57R, and a rear frame 57B which connects rear ends (right ends in FIG. 4) of the left and right frames 57L and 57R. Therefore, the striker supporting frame 59 can move on the guide rails 53 in the Y-axis direction which is the longitudinal direction (lateral direction in FIG. 4).

The left frame 57L of the striker supporting frame 59 is provided at its front end portion with a servomotor 61. A drive pulley 63 is mounted on a rotation shaft of the servomotor 61.

Rotation shafts 69L and 69R extending in the Y-axis direction are rotatably supported by left and right end portions of the striker supporting frame 59 through bearings 65 and 67. A follower pulley 71 is mounted on a position of a front end of the rotation shaft 69L corresponding to the drive pulley 63 of the servomotor 61. A drive belt 73 is wound around the drive belt 73 and the follower pulley 71.

Gear-type timing pulleys 75F, 75B, 77F and 77B are mounted on front and rear ends of each of the rotation shafts 69L and 69R, and gear-type timing belts 79F and 79B are wound. A pair of front and rear striker guide shafts 81F and 81B which connect front and rear ends of the left frame 57L and front and rear ends of the right frame 57R extends in an X-direction (vertical direction in FIG. 4) which is the lateral direction.

Referring to FIGS. 4 and 6, front and rear striker sliders 85F and 85B are fixed to portions of the timing belts 79F and 79B through a connection plate 83. The striker sliders 85F and 85B can reciprocate along the striker guide shafts 81F and 81B. A pair of guide shafts 87 for connecting the striker sliders 85F and 85B are provided in the longitudinal direction (Y-axis direction).

Referring to FIG. 4, the rear striker slider 85B is provided with a first cylinder 89 for moving the striker. An intermediate slider 93 capable of moving along the pair of guide shafts 87 is mounted on a tip end of a piston rod 91 of the first cylinder 89.

A second cylinder 95 for moving the striker is mounted on a left side of the intermediate slider 93. A piston rod 97 of the second cylinder 95 is provided at its tip end with a striker holder 99. The striker holder 99 can move along the guide shafts 87. The striker holder 99 is provided at its central portion with the striker 101. The striker 101 always projects upward and can move downward.

In the above structure, if the rotation shafts 69L and 69R are rotated by the servomotor 61 through the drive belt 73, the timing belts 79F and 79B provided in front and rear of the rotation shafts 69L and 69R rotate in synchronization with each other, and the striker holder 99 is moved and positioned in the X-axis direction which is a lateral direction.

The positioning of the striker holder 99 in the Y-axis direction is determined by expansion and contraction of the first and second cylinders 89 and 95. The first and second cylinders 89 and 95 ate air cylinders which can position the striker holder 99 in only two positions, i.e., an expansion and contraction position and an expansion position. In the embodiment shown in FIG. 4, tools are arranged in three rows, and three positioning can select all of the tools and thus, this structure suffices. Here, assume that the contraction position of the cylinder is OFF, the expansion position is ON, the right row in the Y-axis direction in FIG. 4 is a first row, the center row is a second row, and the left row is a third row. When the die is positioned in the first row, the first and second cylinders 89 and 95 are OFF. When the die is positioned in the second row, the first cylinder 89 is ON and the second cylinder 95 is OFF. When the die is positioned in the third row, the first and second cylinders 89 and 95 are ON.

In this embodiment, as described above, the striker sliders 85F and 85B are positioned in the X-axis direction by the servomotor 61 and the drive belt 73, and positioned in the Y-axis direction by the expansion and contraction of the first and second cylinders 89 and 95, and finally the positioning of the striker holder 99 is completed in an XY table, and a desired punch can be selected speedy.

The precision of centering of the punches P and a die D which are upper and lower tools extremely seriously influences the working precision, but deviations of centers of the punch P and the striker 101 which strikes the punch do not influence the working precision so much. Therefore, in this application, only the light striker 101 having the above-described structure can be positioned speedy in the XY table for the selection of the tools which requires speed more than precision.

Figure 13:
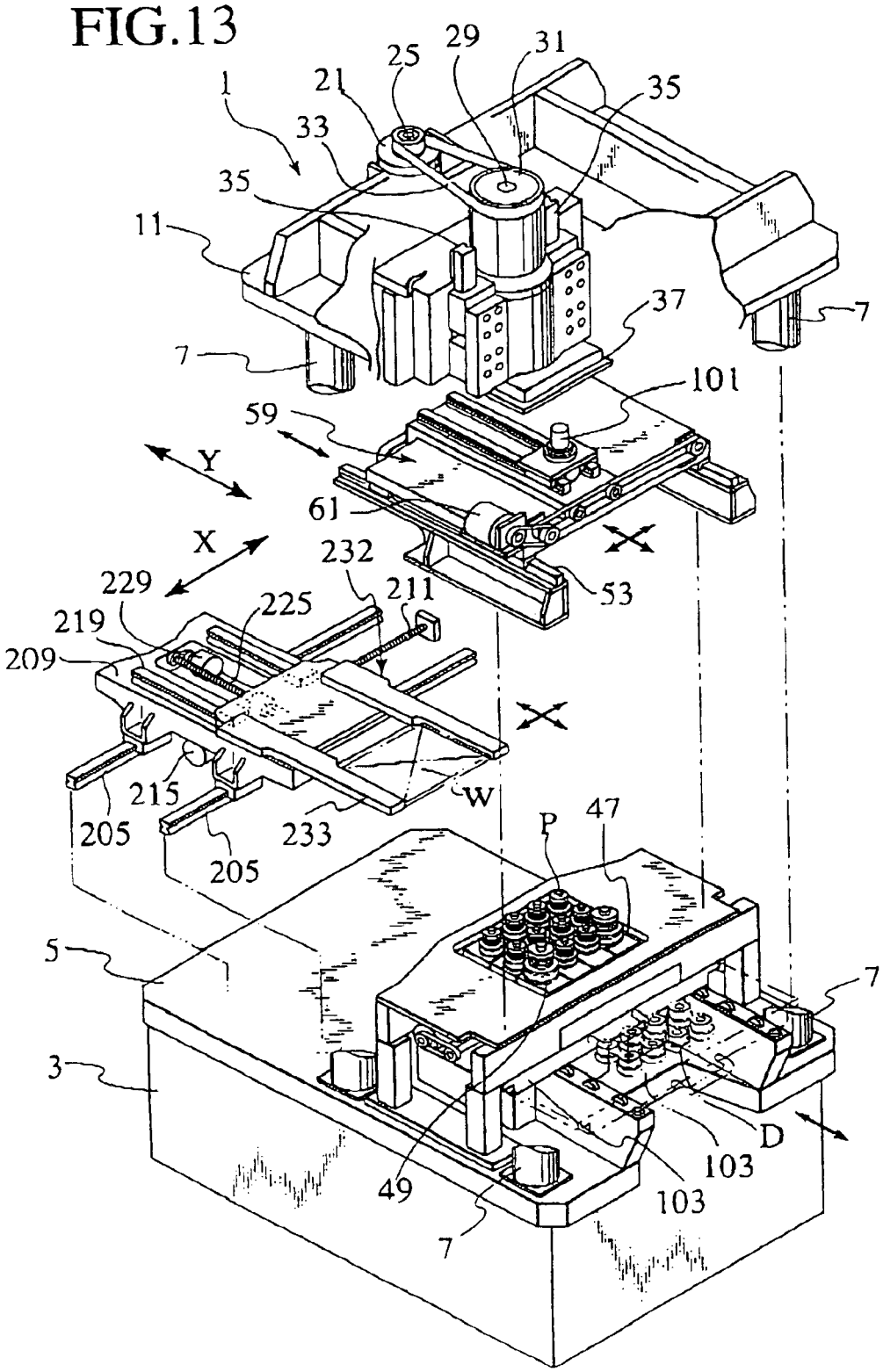
FIG. 13 is a schematic perspective view of the entire punch press.

As shown in FIGS. 1, 2 and 13, the striking surface 39 of the lower end of the ram 37 has such a size that covers either one of a moving range of the striker 101 and a disposing range of the tools of the punches P and dies D. Therefore, if the striker 101 is positioned above a desired punch P and ram 37 is lowered, it is possible to strike the desired punch P through the striker 101.

When the punch P of the punch holder 47 is exchanged or repaired, if the entire striker supporting frame 59 is moved rearward (rightward in FIG. 4) along the guide rails 53, an upper portion of the punch holder 47 is opened. Therefore, it is possible to easily and simply exchange the punch P and perform the maintenance of the punch holder 47. Further, only the striker 101 which does not require the precision positioning can be retreated as described above, safety of punch holder 47 and the punch P is not deteriorated.

Referring again to FIGS. 1 to 3, the base plate 5 is provided at its upper surface front side (left side in FIG. 2) with a die holder 103 on which a plurality of dies D can be mounted.

Figure 7:
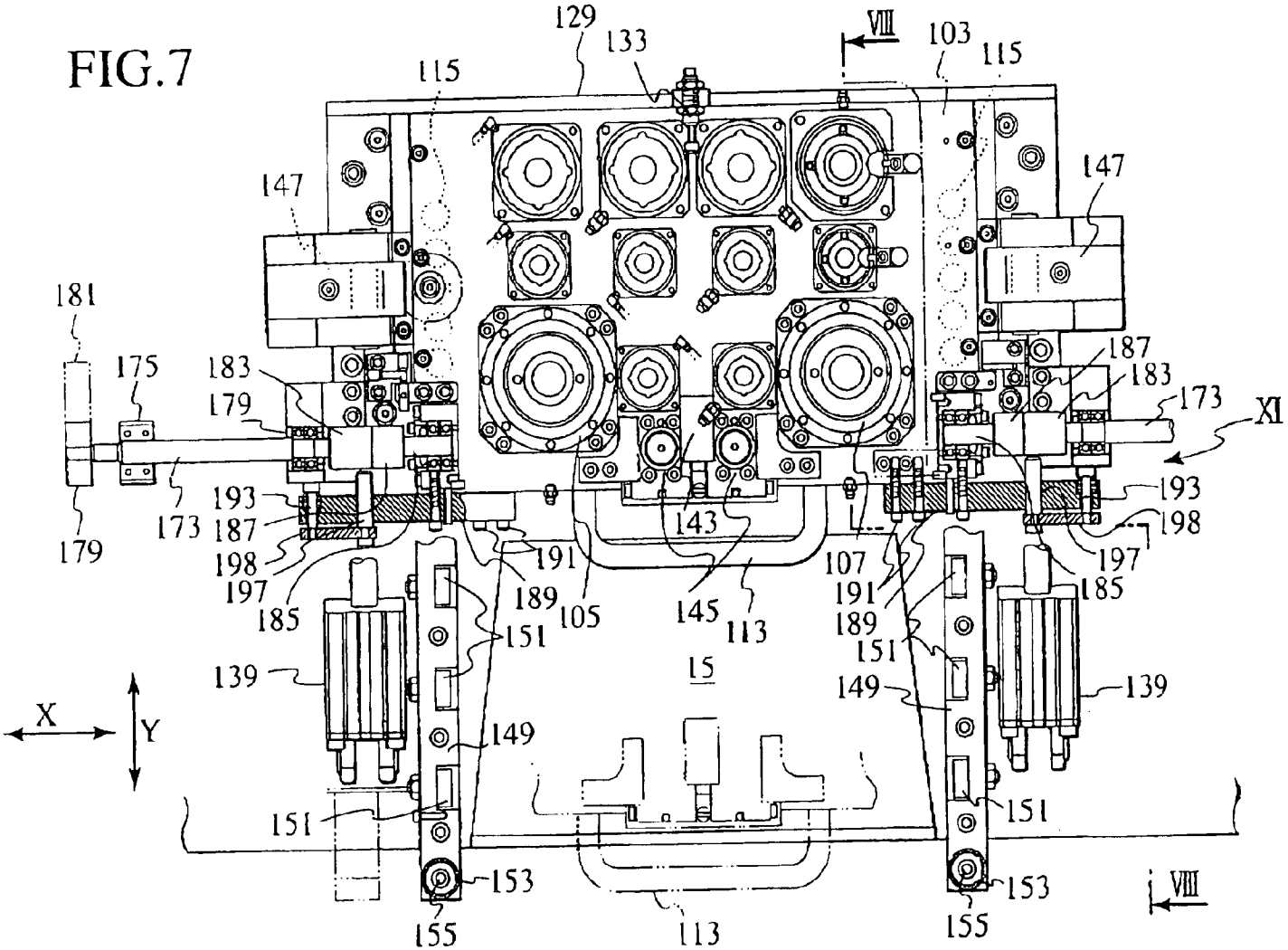
FIG. 7 is a plan view of a die holder.
Figure 8:
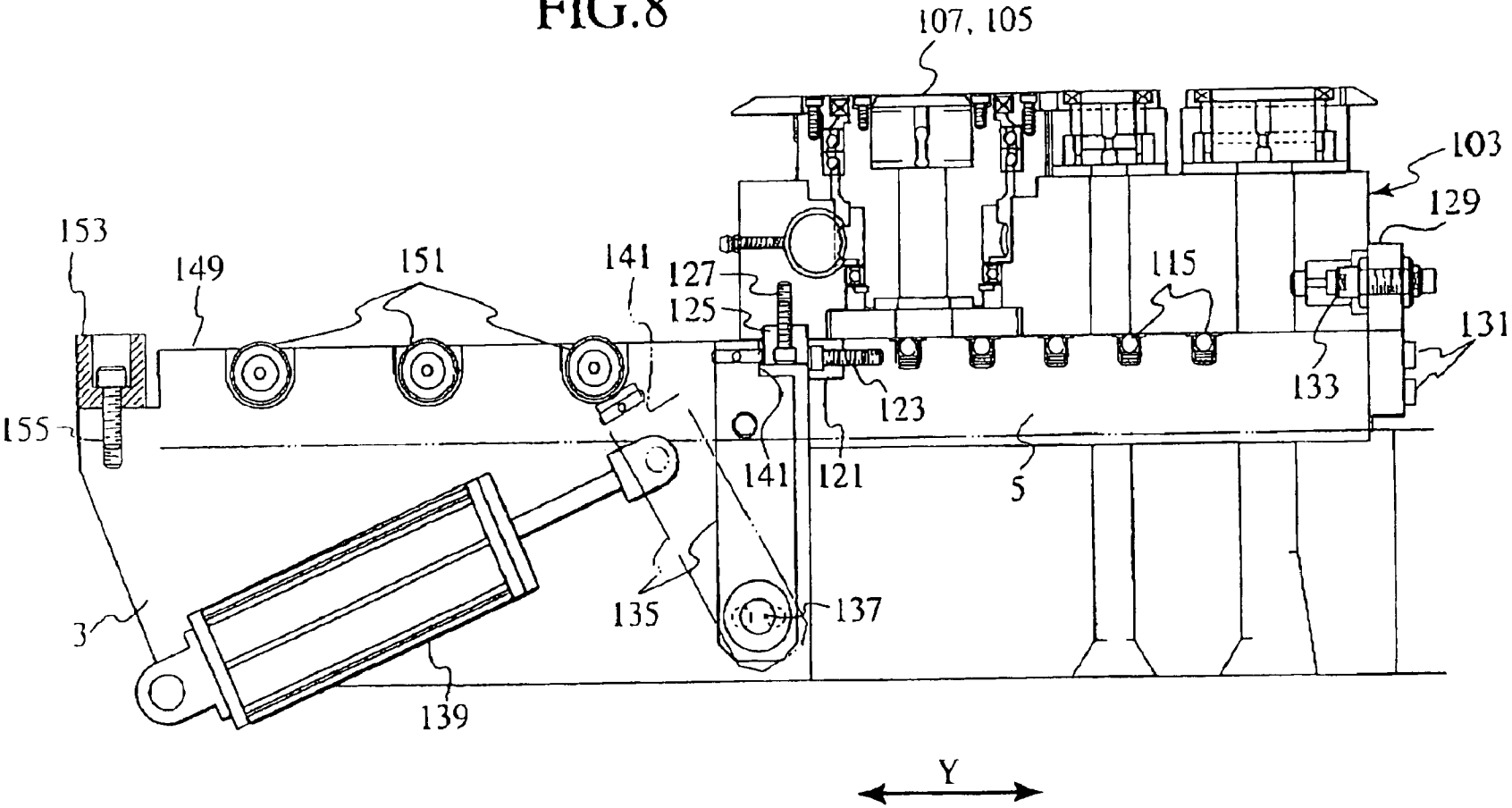
FIG. 8 is a sectional view taken along a line VIII—VIII in FIG. 7.

Referring also to FIGS. 7 and 8, index dies 105 and 107 are rotatably mounted on left and right outer sides of a front row of the die holder 103. Flat gears 109 are provided on outer peripheries of lower portions of the index dies 105 and 107. The die holder 103 is provided with a worm gear 111 which meshes with the flat gear 109. A grip 113 is mounted on a front surface (lower end surface in FIG. 7) of the die holder 103.

Figure 9:
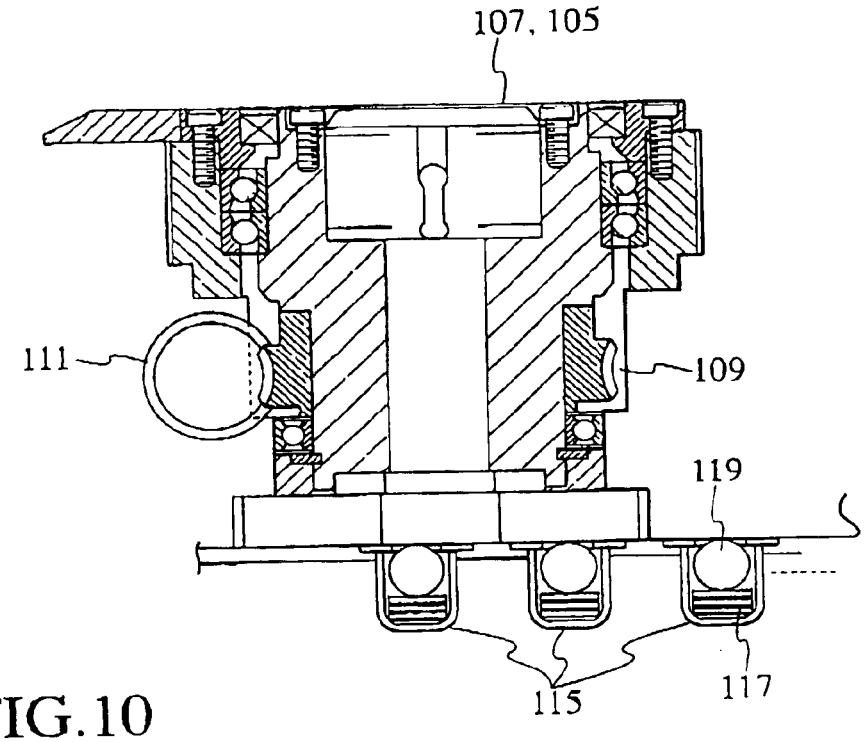
FIG. 9 is a sectional view of a free bearing which supports the die holder.

Referring to FIG. 9, in a state in which the die holder 103 is set, a lower surface of the die holder 103 is supported by a hoisting and lowering type free ball bearing 115 which is provided on an upper surface of the base plate 5 of the pedestal 3, and a bearing 119 is biased upward by a spring 117. Therefore, it is possible to pull out the lower surface of the die holder 103 with a small force.

Referring again to FIG. 8, a body-side abutment block 121 is mounted on an upper surface of the base plate 5 corresponding to left and right side surfaces of the die holder 103 by a bolt 123. The body-side abutment block 121 positions the die holder 103 in the longitudinal direction (lateral direction in FIG. 8).

A die holder-side abutment block 125 is mounted on front ends of left and right side surfaces (lower portion of left end in FIG. 8) of the die holder 103 by a bolt 127. The die holder 103 is positioned in the longitudinal direction by abutting the die holder-side abutment block 125 against the body-side abutment block 121.

A stopper plate 129 is mounted on a deeper side end surface (right side end surface in FIG. 8) of the base plate 5 by a bolt 131 such that the stopper plate 129 project from an upper surface of the base plate 5. The stopper plate 129 is provided at its central portion with a damper 133. The damper 133 absorbs an impact generated when the die holder 103 is sent and the die holder 103 abuts against the stopper plate 129.

The pedestal 3 below the base plate 5 is provided with a die holder fixing block 135 such that the die holder fixing block 135 can turn vertically around the rotation shaft 137. The pedestal 3 is provided with a die holder fixing cylinder 139 which vertically turns the die holder fixing block 135. The die holder fixing cylinder 139 pushes the die holder-side abutment block 125 of the die holder 103 against the body-side abutment block 121 by a notch 141 formed in an upper end of the die holder fixing block 135, thereby fixing the die holder-side abutment block 125 in the longitudinal direction.

Referring to FIG. 7, a center-positioning block 143 for positioning the die holder 103 in the lateral direction is provided on a front end of a central portion of the base plate 5 of the pedestal 3. A pair of center-positioning rollers 145 made of resilient material such as rubber are provided on front end of a lower portion of the die holder 103. The center-positioning rollers 145 sandwich the center-positioning block 143 to position the die holder 103 in the lateral direction.

A distance between outer peripheral surfaces of the pair of center-positioning rollers 145 is set slightly shorter than a width of the center-positioning block 143 of the base plate 5 so that when the die holder 103 is set, both the center-positioning rollers 145 reliably sandwich the center-positioning block 143. A pair of left and right hydraulic die holder clamp devices 147 are provided on an upper surface of the base plate 5 corresponding to the set position of the die holder 103.

Referring to FIGS. 7 and 8, a die holder support rail 149 extends in the Y-axis direction which is the longitudinal direction at a position corresponding to left and right side surfaces of the die holder 103 on left and right outer sides of the recess 15 of the base plate 5 of the pedestal 3. The die holder support rail 149 is rotatably provided with a plurality of die holder transfer rollers 151 arranged at appropriately distances from one another. A stopper 153 such as a roller is mounted on a front side (lower side in FIG. 7) of the die holder support rail 149 by a bolt 155 so that the die holder 103 does not come out forward when the die holder 103 is pulled out.

With the above structure, when the die holder 103 is pulled out forward for exchanging the die D or performing the maintenance, the left and right die holder clamp devices 147 are unclamped, the die holder fixing block 135 is turned toward you by the die holder fixing cylinder 139, and the die holder-side abutment block 125 which is fixed between the die holder fixing block 135 and the body-side abutment block 121 is released. Then, the operator pulls the grip 113 of the die holder 103 toward the operator, and pulls out the die holder 103 toward the operator to a position shown with phantom lines in FIG. 7.

Since the stopper 153 is provided in front of the die holder transfer rollers 151, it is possible to prevent the die holder 103 from being excessively pulled out and from coming out forward.

In a state in which the die holder 103 is pulled out, the base plate 5 is provided at its front central portion with the recess 15 (see FIG. 7) to facilitate the operator's operation. Therefore, the operator puts his or her hand into a lower surface of the die holder 103 to push out the mounted die D upward and pulls out the die D from above.

In order to mount the die D and set the die holder 103, the die holder 103 is straightforwardly placed on the die holder transfer rollers 151, the operator grasps the grip 113 and pushes it forward, the center-positioning rollers 145 of the die holder 103 sandwich the center-positioning block 143 of the base plate 5 to position the die holder 103 in the lateral direction, and die holder-side abutment block 125 is brought into abutment against the body-side abutment block 121 to position the die holder 103 in the longitudinal direction.

At that time, since the front end surface of the die holder 103 abuts against the damper 133 to absorb the impact, it is possible to prevent the die holder-side abutment block 125 and the body-side abutment block 121 from strongly colliding against each other.

The die holder fixing block 135 is upwardly turned by the die holder fixing cylinder 139 to push the die holder-side abutment block 125 against the body-side abutment block 121 to fix the die holder-side abutment block 125, and left and right sides of the die holder 103 is clamped by the die holder clamp devices 147 to fix the die holder 103.

Referring to FIGS. 1 and 3 again, left and right index drive motors 157 are provided on left and right ends of the upper surface of the intermediate frame 43 for rotating and indexing left and right index dies 105 and 107 and the index punch 49. A drive pulley 159 is mounted on the rotation shaft.

An index punch drive shaft 161 is horizontally provided below the index drive motors 157. A central (central of the body in FIG. 1) end of the index punch drive shaft 161 is connected to a worm gear (not shown) which rotates the index punch 49. The index punch drive shaft 161 is rotatably supported by bearings 163 and 165.

A follower pulley 167 is mounted on an outer end of the index punch drive shaft 161. A first belt 169 is wound around the drive pulley 159 and the follower pulley 167. A transmitting drive pulley 171 is mounted on an inner side of the follower pulley 167.

A body-side index die driving shaft 173 which rotates a worm gear 111 is horizontally provided below the index punch drive shaft 161. The worm gear 111 indexes the index dies 105 and 107. The body-side index die driving shaft 173 is rotatably supported by bearings 175 and 177.

Figure 10:
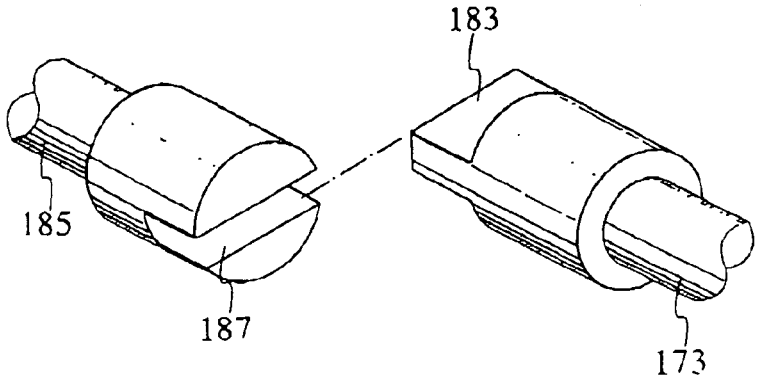
FIG. 10 is a view of a connecting section between a body-side index die driving shaft and a die holder-side index die driving shaft.

A follower pulley 179 is mounted on an outer end of the body-side index die driving shaft 173 at a location below the transmitting drive pulley 171. A second belt 181 is wound around the transmitting drive pulley 171 and the follower pulley 179. Referring to FIG. 10, the body-side index die driving shaft 173 is provided at its center end (left end in FIG. 10) with a connection projection 183 as a body-side connecting section.

Figure 11:
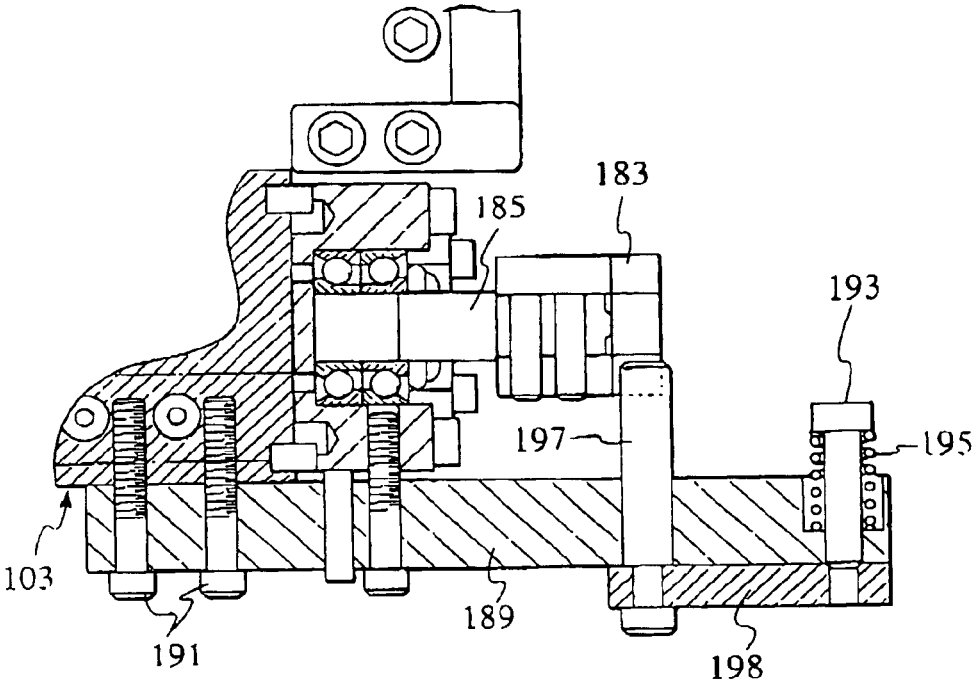
FIG. 11 is an enlarged view of an XI portion in FIG. 7.

Referring to FIGS. 7 and 11 also, a center end of a die holder-side index die driving shaft 185 is mounted on the worm gear 111 which indexes the index dies 105 and 107. Referring to FIG. 10, a connection recess 187 into which the connection projection 183 provided on the body-side index die driving shaft 173 is fitted is mounted on an outer end (right end in FIG. 10) of the die holder-side index die driving shaft 185.

Referring to FIG. 11, sensor brackets 189 are mounted on left and right ends of a front end surface of the die holder 103 through bolts 191, and the sensor brackets 189 project outward (rightward in FIG. 11). A detection pin 193 is biased by a spring 195 toward a deep side (upward in FIG. 11) and projects at the outermost ends of each of the sensor brackets 189. The detection pin 193 is provided therein (left side in FIG. 11) with a lock pin 197 such that the lock pin 197 can move in the longitudinal direction. The lock pin 197 integrally moved together with the detection pin 193 in the longitudinal direction by the connection plate 198.

In a state in which the connection projection 183 is fitted into the connection recess 187, rotation of the body-side index die driving shaft 173 is transmitted to the die holder-side index die driving shaft 185 to rotate the worm gear 111. In a state in which the die holder 103 is set on the body, as shown in FIG. 7, the detection pin 193 abuts against a bearing 177 of the body-side index die driving shaft 173 and the detection pin 193 is pushed out forward (downward in FIG. 7). Therefore, the lock pin 197 also integrally moves forward and is separated from the die holder-side index die driving shaft 185.

As shown in FIG. 10, when the connection projection 183 is in its horizontal state, the left and right die holder clamp devices 147 are unclamped, the die holder fixing block 135 is released by the die holder fixing cylinder 139 and if the die holder 103 is pulled out forward, the die holder-side index die driving shaft 185 can be separated from the body-side index die driving shaft 173.

In a state in which the die holder 103 is separated, as shown in FIG. 11, since the detection pin 193 is pushed out toward the body-side (upward in FIG. 11) by the spring 195, the lock pin 197 is also integrally pushed out toward the body-side, the lock pin 197 is fitted into the connection recess 187 of the die holder-side index die driving shaft 185, the die holder-side index die driving shaft 185 is locked, and the index dies 105 and 107 are fixed so that they do not rotate.

Therefore, when the die holder 103 is taken out for exchanging the die D or performing the maintenance, it is possible to separate the body-side index die driving shaft 173 and the die holder-side index die driving shaft 185 from each other.

Since the connection recess 187 of the die holder-side index die driving shaft 185 can be held horizontally by the lock pin 197, it is possible to hold the index dies 105 and 107 at reference positions. When the die holder 103 is set, it is possible to connect the body-side index die driving shaft 173 and the die holder-side index die driving shaft 185 to each other.

Figure 12:
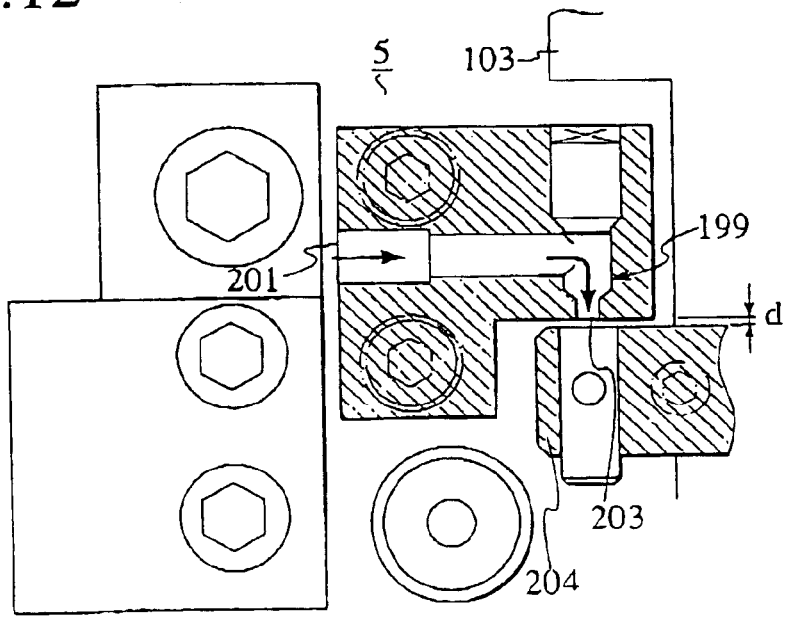
FIG. 12 is an enlarged view of an air catch sensor.

FIG. 12 shows an air catch sensor 199 which confirms whether the die holder 103 is surely set and fixed. The air catch sensor 199 is provided on the base plate 5. The air catch sensor 199 blows air from an air supply port 201 and always blows air from an outlet port 203.

When the die holder 103 is appropriately set, a distance d between the outlet port 203 and the detection bracket 204 mounted on the die holder 103 is set to about 0.01 to 0.4 mm for example. When the distance d is in this range, a pressure of about 500 kgf is detected, but if the distance d is greater than this range, the pressure becomes smaller, and if the distance d is smaller than this range, the pressure becomes greater. Therefore, it is possible to easily confirm whether the die holder 103 is appropriately set.

Figure 14:
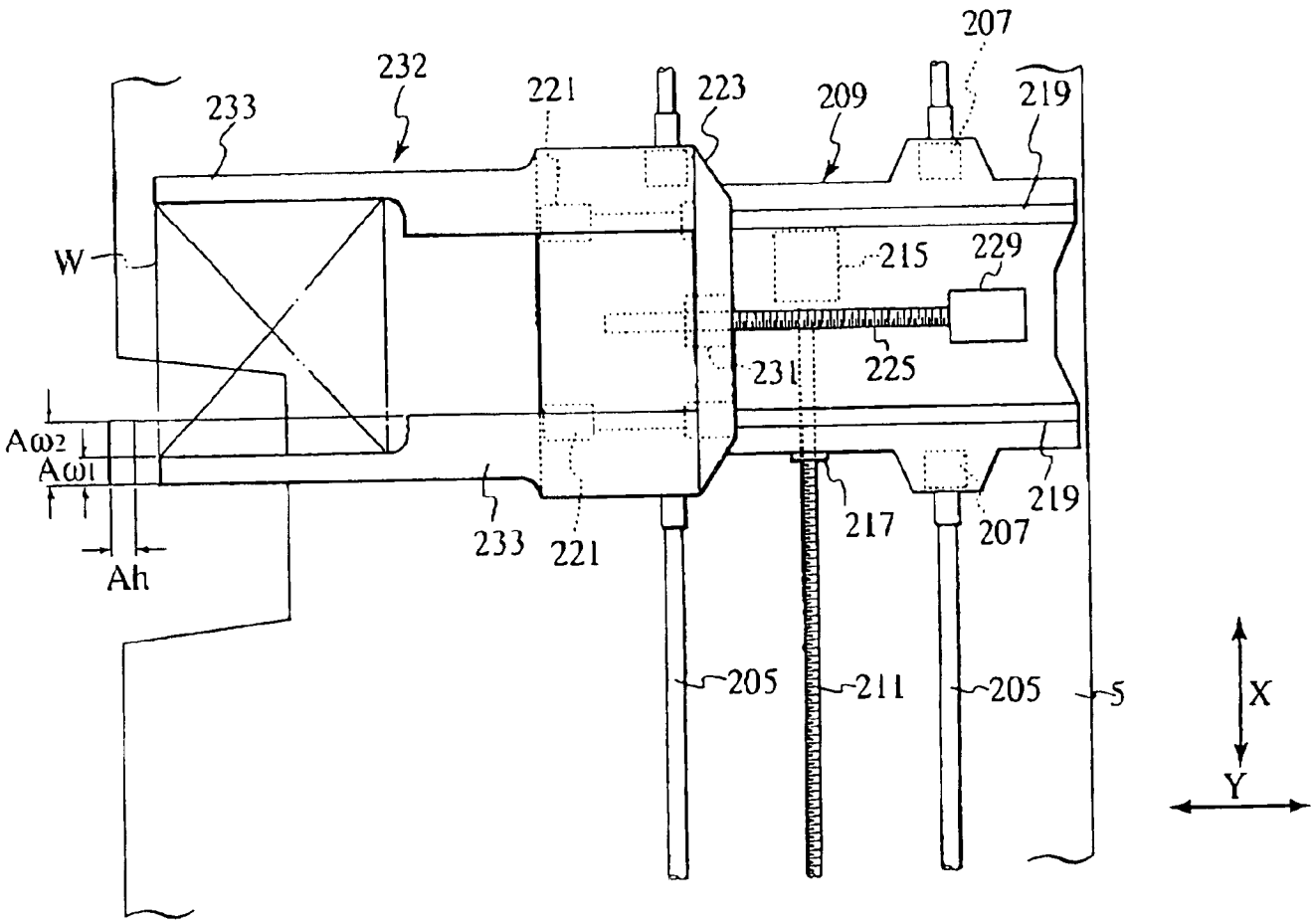
FIG. 14 is a plan view of a work-movement positioning device.

Referring to FIGS. 2, 3 and 14 again, a pair of X-axis guide rails 205 extend in the X-axis direction (vertical direction in FIG. 3)from an upper surface of a rear side (right side in FIG. 2) from a center of the base plate 5 of the pedestal 3. An X-axis carriage 209 is provided through a 6 plurality of X-axis sliders 207 which can move along the X-axis guide rails 205 such that the X-axis carriage 209 can move in the X-axis direction.

An X-axis ball screw 211 is rotatably provided between the pair of X-axis guide rails 205 such that the X-axis ball screw 211 extends in the X-axis direction. One end (upper end in FIG. 3) of the X-axis ball screw 211 is connected to an X-axis motor 215 through a joint 213 (see FIG. 3). An X-axis ball (circulation type) nut 217 which is threadedly engaged with the X-axis ball screw 211 is mounted on the X-axis carriage 209.

The X-axis carriage 209 is provided at its upper surface with a pair of Y-axis guide rails 219 in the Y-axis direction (lateral direction in FIG. 3). A Y-axis carriage 223 is provided through a Y-axis slider 221 which can move along the Y-axis guide rails 219 such that the Y-axis carriage 223 can move in the Y-axis direction.

A Y-axis ball screw 225 is rotatably provided between the pair of Y-axis guide rails 219 such that the Y-axis ball screw 225 extends in the Y-axis direction. One end (right end in FIG. 3) of the Y-axis ball screw 225 is connected to a Y-axis motor 229 through a belt 227 (see FIG. 3). A Y-axis ball (circulation type) nut 231 which is threadedly engaged with the Y-axis ball screw 225 is mounted on the Y-axis carriage 223.

Clamp arms 233 of the clamp device 232 are provided left and right ends (upper end lower ends in FIG. 3) of an upper surface of the Y-axis carriage 223. The clamp arms 233 extend in the longitudinal direction. The clamp arms 233 clamp left and right ends of a workpiece W over their entire widths. Therefore, the clamp arms 233 reliably clamp the thin workpiece W having low rigidity so that the workpiece W is not bent during working.

With the above structure, the clamp arms 233 clamp the left and right ends of the workpiece W over their entire widths, the X-axis motor 215 rotates the X-axis ball screw 211, thereby moving and positioning the X-axis carriage 209 in the X-axis direction. By rotating the Y-axis ball screw 225 using the motor 229, it is possible to move and position the Y-axis carriage 223 in the Y-axis direction, and to locate a workpiece W at a desired position.

A structure of the clamp arm 233 will be explained. It is preferable that a height of the clamp arm 233 is as low as possible to due limitation of a field clearance. If the height of the clamp arm 233 is reduced, the rigidity of the clamp arm 233 is naturally reduced. In order to overcome this problem, it becomes necessary to increase the width of the clamp arm 233. Therefore, in the embodiment shown in FIG. 14, a width Aω2 of a base portion is greater than a height Ah of the clamp arm 233. It is preferable that a width Aω1 of a base portion of a tip end is greater than Ah.

As a result, the height of the clamp arm 233 is reduced, and in order to compensate the reduction of rigidity caused by the reduction of the height, its width is increased. With this shape, it is possible to stably hold the clamped workpiece W against a horizontal stress generated at the time of positioning, and the distance between the punch P and the die D can be reduced. Since the clamp device 232 is disposed rearward, the operability in the forward direction which is a direction in which the die holder 103 is pulled out is not deteriorated.

From the above result, as can be seen especially in FIG. 13, in a cube space having high rigidity surrounded by the base frame 5 and the ceiling plates (ceiling frames) 11, 7, the following members are provided: the die holder 103 which can be pulled out forward, the punch holder 47 fixed to the separate bridge structure, the striker 101 which can be positioned in the XY plane for selecting a desired punch P, the striker supporting frame 59 which can slide in the horizontal direction, and the clamp arms 233 which are provided with the vertically movable ram 37 and which can enter between the punch holder 47 and the die holder 103 and which hold the opposed ends of the workpiece W. Therefore, it is possible to center the tools with precision, to reduce the stroke amount of the punch, to increase the speed for selecting tools, and to reduce the energy. Since space of the upper surfaces of the punch holder 47 and the die holder 103 can sufficiently be secured by the slide mechanisms of the striker supporting frame 59 and the die holder 103, the maintenance performance such as exchange of tools is not deteriorated.

The present invention is not limited to the above embodiment, and the invention can be carried out in other embodiments with appropriate modification.

Although the die holder can be pulled out toward an operator (forward) horizontally in the present embodiment, the die holder may be pulled out in the left direction and the horizontal direction including the left direction of the device.

What is claimed is:

1. A punch press comprising:

a base frame;

a die holder mounted on the base frame;

a rectangular punch holder fixed on an upper position of the die holder and provided thereon with a large number of punches arranged in many rows and many lines;

a striker supporting frame provided on an upper position of the punch holder and having a striker which can be positioned in an XY plane, the striker being supported by the striker supporting frame such that the striker can strike the punch; and a vertically movable ram provided on an upper position of the striker supporting frame, the ram having a striking surface for covering an XY plane region where the striker moves, wherein the die holder can be pulled out in a horizontal direction.

2. A punch press according to claim 1, wherein the striker supporting frame is capable of moving in the horizontal direction.

3. A punch press according to claim 2, wherein a ceiling frame is supported by at least four columns which stand on the base frame, the ram is provided in the vicinity of a center of the ceiling frame surrounded by the columns; and the punch holder and the die holder are surrounded by the columns in correspondence with the structure.

4. A punch press according to claim 3, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

5. A punch press according to claim 2, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

6. A punch press according to claim 1, wherein a ceiling frame is supported by at least four columns which stand on the base frame, the ram is provided in the vicinity of a center of the ceiling frame surrounded by the columns; and the punch holder and the die holder are surrounded by the columns in correspondence with the structure.

7. A punch press according to claim 1, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

8. A punch press comprising:

a base frame;

a die holder mounted on the base frame in which dies are arranged in many rows and many lines on an XY plane;

a punch holder provided on an upper position of the die holder in which left and right ends of the punch holder are strongly fixed to the base frame to form a bridge structure, and punches paring up with the dies are arranged in many rows and many lines on an XY plane;

a striker supporting frame provided on an upper position of the punch holder, the striker supporting frame having a striker capable of striking the punch and moving in the XY plane; and a ram provided on an upper position of the striker supporting frame, the ram vertically moving such that the ram can strike the striker irrespective of position of the striker;

wherein the die holder can be pulled out in a horizontal direction.

9. A punch press according to claim 8, wherein the striker supporting frame is capable of moving in the horizontal direction.

10. A punch press according to claim 9, wherein a ceiling frame is supported by at least four columns which stand on the base frame, the ram is provided in the vicinity of a center of the ceiling frame surrounded by the columns; and the punch holder and the die holder are surrounded by the columns in correspondence with the structure.

11. A punch press according to claim 10, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

12. A punch press according to claim 9, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

13. A punch press according to claim 8, wherein a ceiling frame is supported by at least four columns which stand on the base frame, the ram is provided in the vicinity of a center of the ceiling frame surrounded by the columns; and the punch holder and the die holder are surrounded by the columns in correspondence with the structure.

14. A punch press according to claim 8, further comprising a clamp section for clamping opposed opposite sides of a plate-like workpiece, wherein in order to make it possible for the clamp section to enter a gap between the punch holder and the die holder, a vertical height of the clamp section is set smaller than the gap;

a width of a plane of the clamp section is set greater than the vertical height thereof; and the punch press further comprises a clamp device which can be positioned in X-axis direction and Y-axis direction in a rear end.

* * * * *

UNITED STATES PATENT AND TRADEMARK OFFICE

CERTIFICATE OF CORRECTION

PATENT NO. : 6,931,909 B2
DATED : August 23, 2005
INVENTOR(S) : Punch Press

It is certified that error appears in the above-identified patent and that said Letters Patent is hereby corrected as shown below:

Column 13,
Line 8, "paring" should be -- pairing --.

Signed and Sealed this

Eighteenth Day of April, 2006

JON W. DUDAS
*Director of the United States Patent and Trademark Office*